US010085488B2

(12) United States Patent
Kies

(10) Patent No.: US 10,085,488 B2
(45) Date of Patent: Oct. 2, 2018

(54) PORTABLE VAPORIZER AND STORAGE SYSTEMS

(71) Applicant: Nathan R. Kies, Tempe, AZ (US)

(72) Inventor: Nathan R. Kies, Tempe, AZ (US)

( * ) Notice: Subject to any disclaimer, the term of this patent is extended or adjusted under 35 U.S.C. 154(b) by 0 days.

(21) Appl. No.: 15/424,293

(22) Filed: Feb. 3, 2017

(65) Prior Publication Data

US 2017/0215479 A1 Aug. 3, 2017

Related U.S. Application Data

(60) Provisional application No. 62/290,669, filed on Feb. 3, 2016, provisional application No. 62/323,960, filed on Apr. 18, 2016, provisional application No. 62/333,278, filed on May 9, 2016, provisional application No. 62/374,806, filed on Aug. 13, 2016.

(51) Int. Cl.

| | |
|---|---|
| ***A24F 47/00*** | (2006.01) |
| ***F22B 1/28*** | (2006.01) |
| ***A24F 3/00*** | (2006.01) |
| ***A24F 3/02*** | (2006.01) |
| ***A24F 1/26*** | (2006.01) |

(52) U.S. Cl.

CPC ..... *A24F 47/008* (2013.01); *A24F 1/26* (2013.01); *A24F 3/00* (2013.01); *A24F 3/02* (2013.01); *F22B 1/28* (2013.01)

(58) Field of Classification Search

None

See application file for complete search history.

(56) References Cited

U.S. PATENT DOCUMENTS

| | | | | |
|---|---|---|---|---|
| 2,104,266 A * | 1/1938 | McCormick | A24F 47/008 131/175 |
| 3,618,174 A * | 11/1971 | Schainholz et al. | A41F 1/002 24/303 |
| 3,822,711 A * | 7/1974 | Egger | A24F 3/02 131/184.1 |
| 4,484,590 A * | 11/1984 | Singh | A24F 1/26 131/180 |
| 5,456,269 A * | 10/1995 | Kollasch | A24F 1/00 131/198.1 |
| 6,196,232 B1 * | 3/2001 | Chkadua | A24F 1/00 131/178 |

* cited by examiner

*Primary Examiner* — Michael J Felton
(74) *Attorney, Agent, or Firm* — Bycer Law, PLC; Matthew L. Bycer

(57) ABSTRACT

A portable vaporizer with at least one detachable storage compartment for storing a significant amount of smokable materials. The storage compartment is accessed by opening a door so smokable material can be conveniently poured from a spout into the vaporizer's heating chamber. A tool designed for specific purposes is integrated into the detachable storage for use with scooping, loading, stirring, packing, cleaning, or extracting the smokable materials into, from, or within the heating chamber. The detachable storage compartment having an extended surface to fit partially inside the heating chamber tightly packs the smokable material. In instances where a tool is used to scoop the smokable materials, the heating chamber has a nub to aid in the transfer of the smokable material from the tool onto the nub within the heating chamber. A heating chamber is constructed of glass, and a heating element is embedded in the glass base and/or walls.

20 Claims, 23 Drawing Sheets

PORTABLE VAPORIZER AND STORAGE SYSTEMS

CROSS REFERENCE TO RELATED APPLICATIONS

The present application includes subject matter disclosed in and claims priority to the following four (4) provisional applications: Ser. No. 62/290,669, filed Feb. 3, 2016 and entitled "Inhaler"; Ser. No. 62/323,960, filed Apr. 18, 2016 and entitled "Electronic Vaporizer Heater with Transfer Aid"; Ser. No. 62/333,278, filed May 9, 2016 and entitled "Electrical Glass Heater for Portable Vaporizer"; and Ser. No. 62/374,806, filed Aug. 13, 2016 and entitled "Portable Vaporizer with Attachable Storage Assembly"; each application of which is hereby incorporated herein by reference and describing inventions made by the present inventor.

BACKGROUND OF THE INVENTION

1. Field of the Invention

The present invention relates to portable vaporizers for provision of inhaled gases or particulates. This invention is more particularly related to handheld vaporizers for electrical heating of volatile compounds for inhalation.

2. Description of Related Prior Art

The present invention provides an improvement to portable handheld devices for smoking and vaporizing of substances for inhalation by users and patients. It is well known in the art to provide for heating, or burning, of particularly volatile compounds that causes the release of gases or particulates into a smoke or vapor that can then be inhaled by the user. Such inhalation of vapors provides for interaction of the vapors with the user's mouth, throat, and lungs to provide absorption of chemicals, pharmaceuticals, or other materials. Earlier embodiments of inhalation devices often utilized fire or heat that would raise temperatures well above 400 degrees Fahrenheit to combust volatile materials. Combustion of volatile materials can often lead to extraction or vaporization of unwanted byproducts. Combustion can also cause the distortion, or reaction, of compounds in the volatile source that changes the nature of the material to be inhaled or inhibit absorption of same. Therefore, it has become common practice to utilize controlled heating of volatile compounds to ensure release of specific chemicals, and/or compounds, into a vapor for inhalation. The controlled heating of the volatile compounds provides for a selective release of chemicals, and can prevent combustion or other chemical reactions that may occur at higher temperatures.

Many handheld vaporizers have been invented to provide for this controlled heating of volatile compounds that allow for inhalation by a user. The prior art fails to provide a vaporizer that is useful to provide storage of a multi-faceted form of volatile compounds. Currently, volatile compounds can come in a basic herb form, dehydrated herb, wax, liquid, etc. Furthermore, attempts at providing storage have fallen short of adequate storage space, and utility for access and deployment.

Additional issues with prior art vaporizers include the lack of ease for proper maintenance. Many vaporizers include a heating coil that is directly applied to the volatile compound. This heating coil can then become sullied, dirty, or otherwise impacted with materials. Advances in chemicals, materials, and embedded heating coils in materials have allowed for the invention hereby described.

It is therefore a primary object of the present invention to provide for a handheld vaporizer that includes storage for a power source and scoop tool.

It is another object of the present invention to provide for a handheld vaporizer with detachable storage.

It is yet another object of the present invention to provide a magnetically locking mechanism for a vaporizer and related items.

It is yet another object of the present invention to provide for a storage compartment above the heating element positioned between the heater and mouthpiece.

It is yet another object of the present invention to provide for a novel heating chamber within a handheld vaporizer.

It is as yet another object of the present invention to provide for a heating chamber element that enables easy deposition of wax product into a heating chamber.

It is yet another object of the present invention to provide for a vaporizer with detachable storage to store additional volatile compound that can be easily transferred into a heating chamber.

These and other objects of the present invention will become apparent to those skilled in the art as the description thereof proceeds.

SUMMARY OF THE INVENTION

The present invention includes an inhaler for vaporizing a volatile substance into a vapor. The inhaler preferably includes a heater adapted to raise the temperature or otherwise cause vaporization of materials present in the volatile substance. The heater typically will include a heating chamber to house the volatile substance that is being acted upon. The heater may include a heating element and be structured in such a way that it has a base floor and a wall. The wall could be a singular cylindrical wall, or other conical section, or the wall may be one of many walls that provide the horizontal support to the heating chamber. The heating chamber may be enclosed on five of six directions, with an open top, or otherwise arrange to allow for packing of additional volatile substances into heating chamber to allow for vaporization.

The inhaler preferably includes a mouthpiece that is adapted for a user to draw vaporized gases or particulates from the inhaler. The mouthpiece should be in fluid communication with the heater in order to direct vapor from the heater to the user for inhalation. The inhaler may include a power source that is electrically coupled to the heater to power the heater. If the power source is not an electrical source, the power source may be otherwise coupled to the heater to provide action. The inhaler includes a body that houses the heating element and preferably also the power source. A switch is used to turn the power source on and otherwise control the power output from the power source to the heater.

In an embodiment disclosed herein, a storage compartment can be coupled to the body or otherwise part of the body. The storage compartment should have a cavity for containing additional material. The storage compartment may be used to include storage for additional volatile substance. The storage compartment can also be used to store items such as the power source (e.g., a battery) or a tool that is useful. For instance, a scoop tool may be used to put volatile substance into heating chamber. In such instances as a wax is used as a volatile substance, scoop tool is most readily useful.

In an embodiment shown herein, the storage compartment can be a separable detachable element that may have an access door to provide for opening and closing access to the items within the storage cavity. The access door may be sliding, hinged, or otherwise known in the art. It is preferable that the detachable storage mates with one side of the inhaler body, even more preferably such that it complements the shape and/or features on the exterior of the body. For instance, should one side of the inhaler body include an indentation around circumference of the side, the storage compartment would then have a bossed rim. Similarly, if the side of the inhaler body has a bossed rim, the storage compartment would have an indented rim. Therefore, the inhaler body side has a complementary face to the storage compartment.

In an alternative embodiment of the present invention, a vaporizer may have a heater and mouthpiece, and otherwise function in the same manner as the inhaler embodiment above. However, in the alternative embodiment, a storage chamber is housed between the heater and mouthpiece. In such an embodiment, a tube provides fluid communication between the heater and the mouthpiece, while the storage chamber fits as an annulus, or other shape, around the tube leading to the mouthpiece. In this embodiment, the mouthpiece serves as a cap to otherwise contain the storage chamber.

The heating chamber may include a hollow post whereby a heating element is placed within the hollow post, from below the heating chamber, in order to provide heat to emanate within the heating chamber around and above the post. The post, or another item of the heater, may include a nub that is useful to catch or otherwise grab material, such as a wax. The nub may have a sharp edge or a sharp point to facilitate transfer. Alternatively, there may be one or two nubs extending to allow capture of material between the two nubs. These nubs may include two or more parallel planar bodies. In another alternative, the heating chamber may include a ribbed surface, such as a ribbed wall or a ribbed nub or post.

In another alternative embodiment, an inhaler is useful for the production of airborne gases and/or particulates from a volatile substance, and for directing the gases and/or particulates to a user through a mouthpiece. Similarly, the inhaler will include a heated chamber for housing the volatile substance. In such embodiment, the heating element is coupled with the floor below the floor surface that is exposed to the volatile substance. For instance, the floor of the heating chamber may include an embedded coil within a glass floor. The floor may be of a glass ceramic or glass-ceramic material. Furthermore, the wall, or walls, may include embedded heating elements therein. In such an embodiment, it is preferred that there be a single wall that circumscribes the chamber in order to provide 360 degrees of heating, as understood from a cross-sectional view.

In another alternative embodiment of the present invention, the inhaler includes a detachable storage compartment with a locking mechanism for detachably mating the detachable storage with at least one side of the inhaler. The storage compartment may include resealable closure means, and may include resealable closure means on two ends such as a top and bottom. The storage compartment may also include an extending lip to allow for pouring from the storage compartment into the heating chamber. The storage compartment may also include a sliding shelf to allow for access to material within the storage compartment.

In one preferred embodiment, the storage compartment includes an indentation along the storage compartment side that is adapted to mate with the inhaler body. This indentation may include a longitudinal space to allow a scoop tool to be attached thereto, preferably by a magnet. A finger hold may also extend from the scoop tool indentation along the storage compartment side to allow easier access.

BRIEF DESCRIPTION OF THE DRAWINGS

The present invention will be described with greater specificity and clarity with reference to the following drawings, in which.

DETAILED DESCRIPTION OF THE PRESENT INVENTION

A portable vaporizer having at least one detachable storage compartment to allow for significant storage space for volatile materials. The storage compartment having at least one access door to allow convenient pouring of the volatile substance into the heating chamber of the vaporizer. A tool designed for specific purposes is integrated into the detachable storage for use with scooping, loading, stirring, packing, cleaning, or extracting the volatile materials into, from, or within the heating chamber. The detachable storage further having a protruding surface matable to the heating chamber for packing of the volatile materials. In instances where a tool is used to scoop the volatile materials, the heating chamber has a nub to aid in the transfer of volatile materials from the tool into the heater. A heating chamber is constructed of glass, and a heating element is embedded in the base and/or walls.

Figure 1:
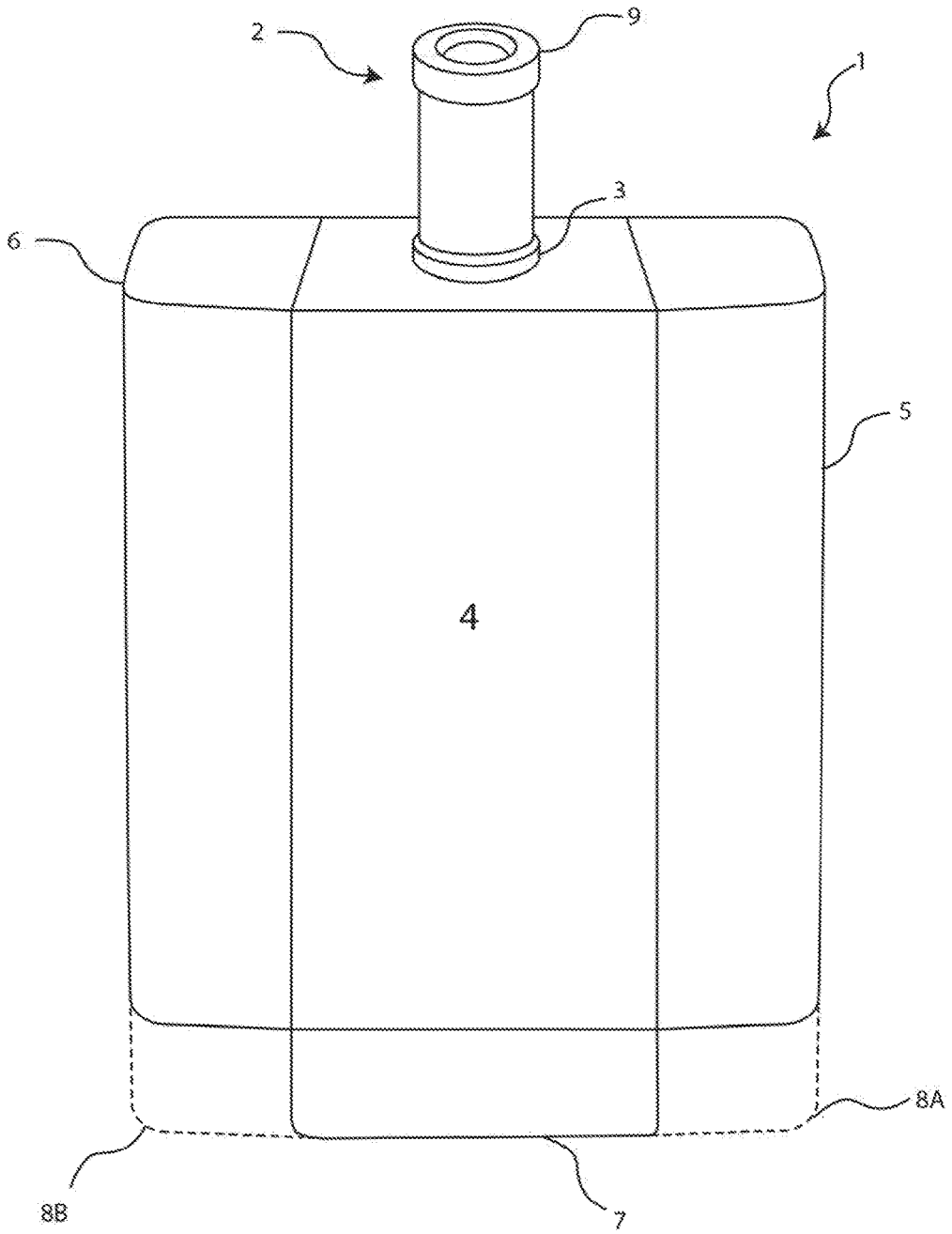
FIG. 1 shows a perspective view of an embodiment of the present invention.

Portable vaporizer 1 can be an inhaler or otherwise any device that can heat or otherwise cause the escape of gases or particulates from a volatile compound for inhalation by a user. It is preferable throughout this description to describe a handheld device for such purposes. As can be seen in FIG. 1, portable vaporizer includes mouthpiece 2 atop main body 4. Mouthpiece includes rim 9 adapted for a user's lips to seal and inhale therethrough. Mouthpiece includes joint 3 for coupling mouthpiece to body 4. In this embodiment, portable vaporizer 1 includes two side storages, first storage compartment 5 on a first side the right, and second storage compartment 6 on the left positioned on a second side. In this example, the first and second sides are opposite each other. However, it should be understood that the first and second storages may be positioned in other configurations as well, such as on adjacent sides. In addition, the first and second storages may be positioned on the same side, and separated by a divider or other component. Additionally, a bottom third storage compartment 7 is shown. Optional extending edges 8*a* and 8*b* may be included to extend the size and shape of bottom storage 7.

Figure 2:
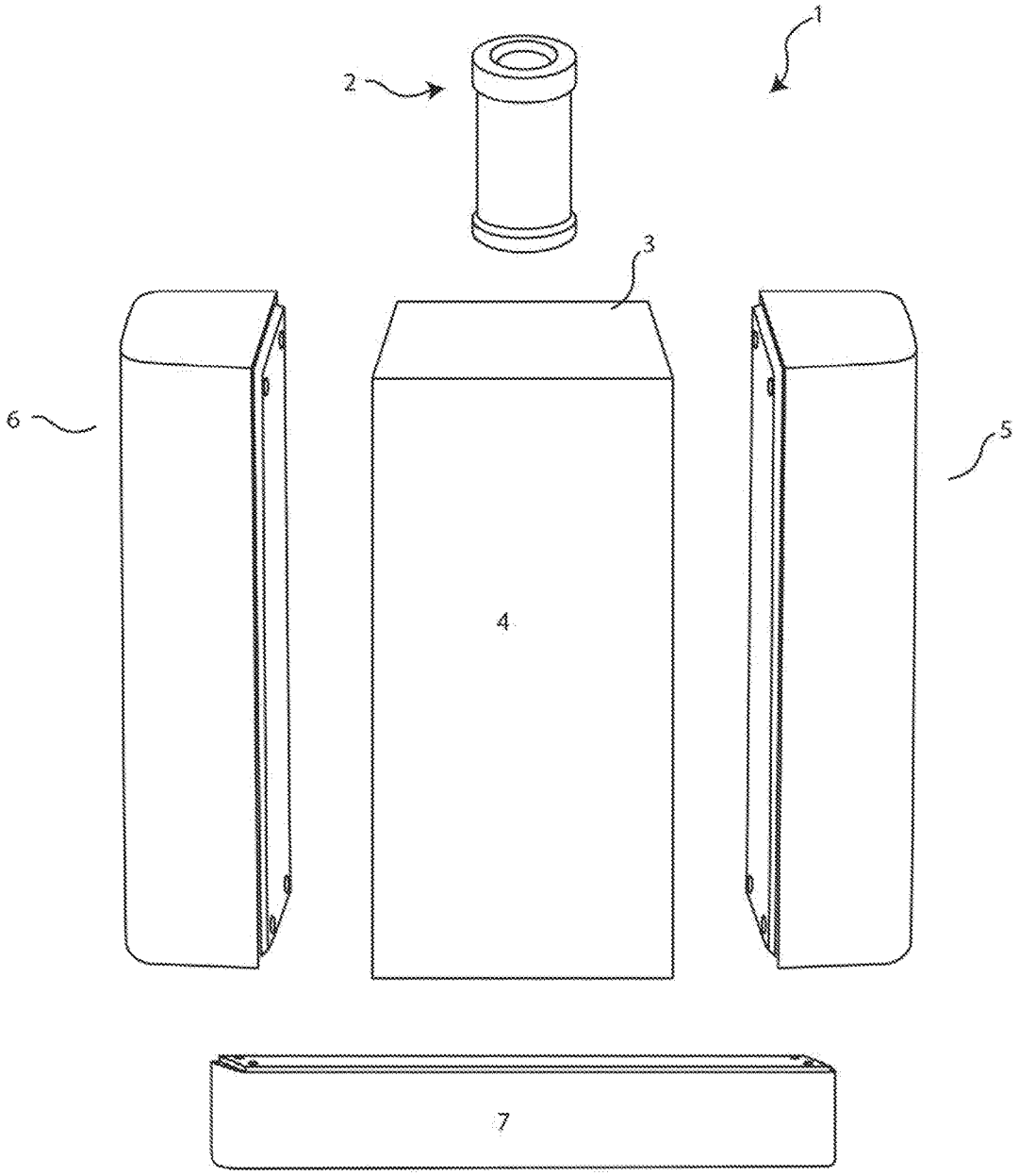
FIG. 2 demonstrates an exploded version of an embodiment shown in FIG. 1.
Figure 3:
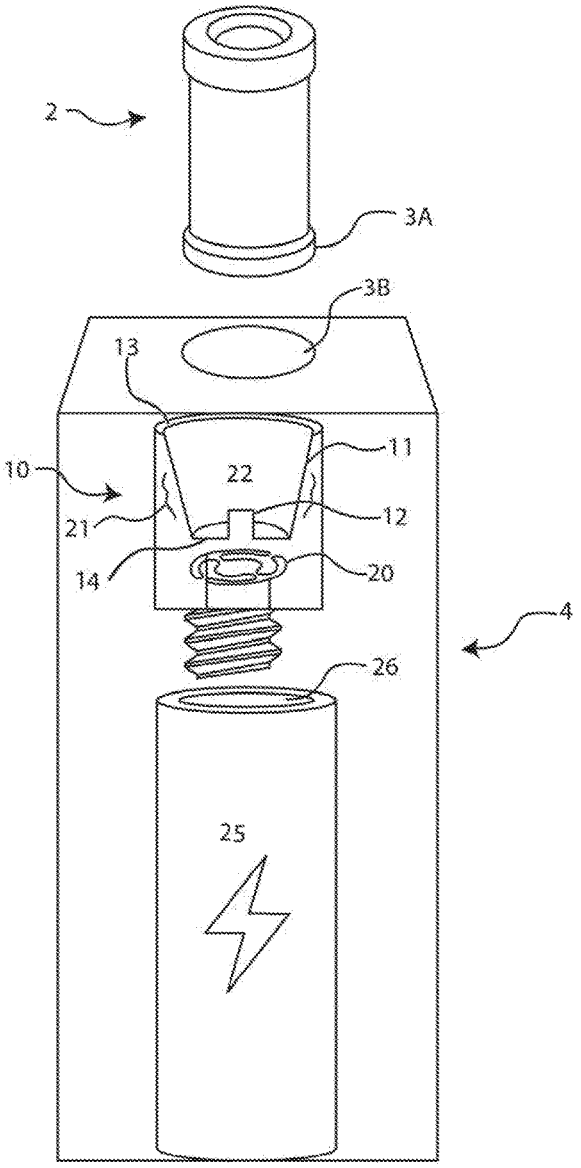
FIG. 3 demonstrates a see-through view of a center portion of an embodiment of the present invention.

As shown in FIG. 2, an exploded version of the portable vaporizer 1 from FIG. 1. Mouthpiece 2 attaches the top of body 4. Storage compartments 5, 6, and 7 are detachable from the main body 4 and can be used to carry storage separately or with body. One benefit of detachable storage is that you can now clean the storage area more easily because it is not part of your electric vaporizer so you can run water through it. It is preferred that storage compartments couple with main body in some sort of fixed fashion, such as a magnetic lock. Furthermore, features on the body may complement with features on a side of the storage compartment to allow for a smooth mating. As seen in FIG. 3, mouthpiece 2 attaches to the top of body 4, such as by press-fit, friction fit, or corresponding threads on both the mouthpiece 2 and body 4. For instance, mouthpiece 2 may be attached via threads 3*a* to complementary mating threads 3*b* along main body top as shown. Heating chamber 10 houses an area where a volatile compound can be stored and heated. Heating chamber 10 is in fluid communication with mouthpiece 2 to allow gases and/or particulates, otherwise known as vapors, to leave heating chamber 10 and exit through mouthpiece 2 and ultimately be inhaled by a user, or otherwise stored as a vapor for later use. In this embodiment, heating chamber 10 includes chamber wall 11 that circumscribes the entirety of the heating chamber 10. Chamber wall 11 forms a conical section to circumscribe the heating chamber, such as a cylinder, or in this case a cone section. Heating chamber may have an openable top or open top 13 that otherwise allows fluid communication to reach the mouthpiece. Heating chamber 10 may also include a nub 12, or other transfer node, as is known in the art or otherwise described elsewhere in this specification and those related applications. Heating element 20 rests below floor 14 of heating chamber 10. Heating element provides for heat below the floor surface of the heating chamber to allow heat to reach and otherwise raise the temperature of the volatile compound within the heating chamber. Heating chamber may be impermanently attached by a threaded engagement to an element within the main body 4 to allow both electronically coupling, as well as physical mechanical coupling, into the device. For instance, the heating chamber 10 may be threaded, or otherwise mated, with power source 25. In this case, power source 25 is shown as a battery with mated contact 26.

Mouthpiece may be attached via threads 3*a* to complementary mating threads 3*b* along main body top as shown. Heating chamber walls may include embedded wall heaters 21 to provide for more thorough heating of the space 22 within the heating chamber.

Figure 4:
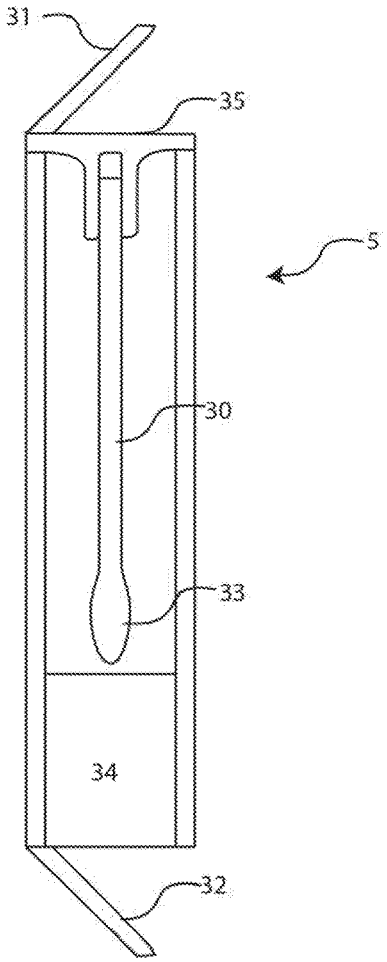
FIG. 4 shows a side view of a storage compartment portion of an embodiment of the present invention.

As shown in FIG. 4, the removable storage compartment 5 is shown as a side view whereby the side facing the main body is exposed. Top lid 31 and bottom lid 32 are shown ajar. Scoop tool 30 is also shown with scoop tool head facing downward. Scoop tool is placed upon the exterior frame of the storage compartment 5 while the storage compartment 5 is otherwise providing a cavity for storage of material. In this embodiment, side storage 5 includes lower cavity 34 to supply a separate storage compartment from that accessible via top opening 35. Scoop tool 30 may include a head for application to scoop wax or other like substance. Scoop tool 30 may also be a general tool without a head for use as a stirrer, extractor, compactor, or cleaner.

Figure 5:
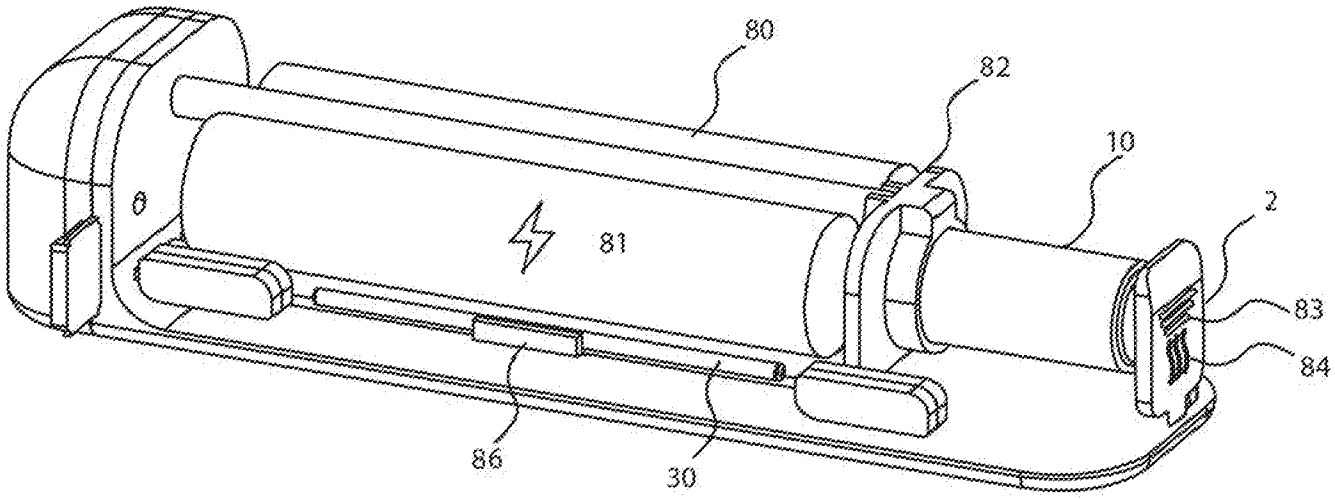
FIG. 5 shows a partially deconstructed perspective view of an embodiment of the present invention.

As shown in FIG. 5, the frame has been removed from the body of the present invention to show the interior. From this embodiment, the power source includes dual batteries in electrical coupling engagement with a heating element. Batteries 80 and 81 mate via electric coupling 82 to heating chamber 10. Heating chamber 10 may be threadedly engaging coupling element 82 to allow for maintenance repair and/or replacement of heater. Heating chamber 10 is in fluid communication with heating chamber door 85 that otherwise includes slits 83 whereby air or gas or particulates can be drawn from heating chamber and heating symbol 84. Addition al air flow holes may be included whereby return air can be returned into heating chamber to minimize vacuum. Scoop tool 30 is shown stored next to battery 81. Scoop tool may include a magnetic seal 86 to hold scoop tool in place. In this, and other embodiments, storage may be useful in its ability to store a multitude of accessories, including a tool, extra battery, filters, and cleaning supplies like wipes and brushes.

Figure 6:
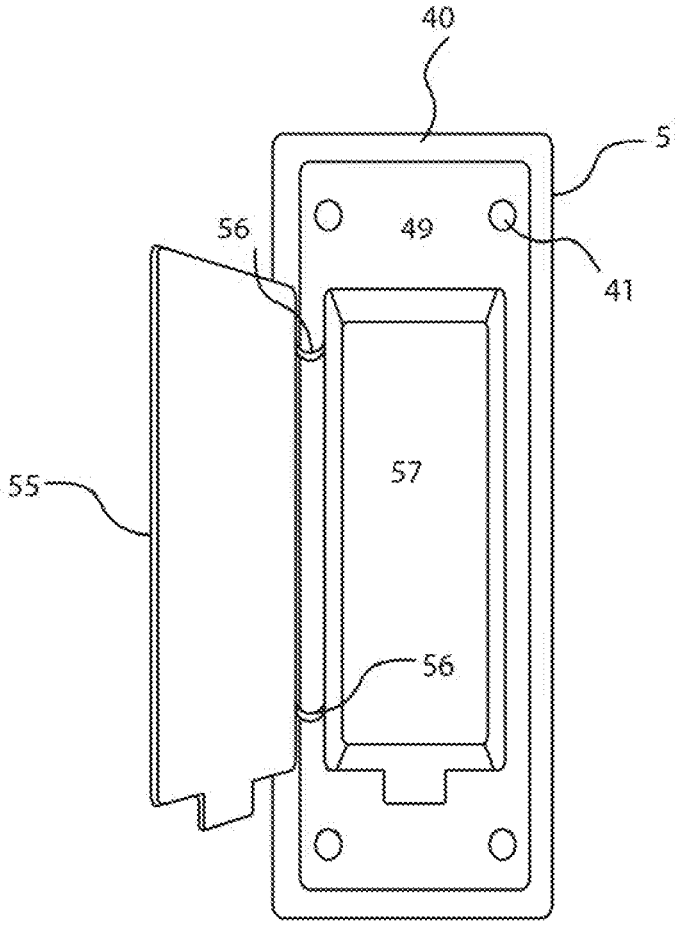
FIG. 6 demonstrates a side view of a storage compartment portion of an embodiment of the present invention.

As shown in FIG. 6, side view of storage compartment 5 of an alternative embodiment is shown. In this embodiment, recessed rim 40 surrounds extending center 49. Further indentations 41 may be included to provide for additional features on storage compartment to allow for better complementary fit and easier mating with main body, for instance, this may be friction fit, press-fit, etc. Indentation 41 may also include imbedded magnets that provide for mating with complimentary magnets or magnetic material on the related face of the inhaler (not shown). In this embodiment, storage compartment cavity 57 within storage compartment 5 provides for side access via hinged door 55 along hinges 56. A similarly configuration as illustrated in FIG. 6 may also be implemented on one or both of second storage compartment 6 and third storage compartment 7.

Figure 7:
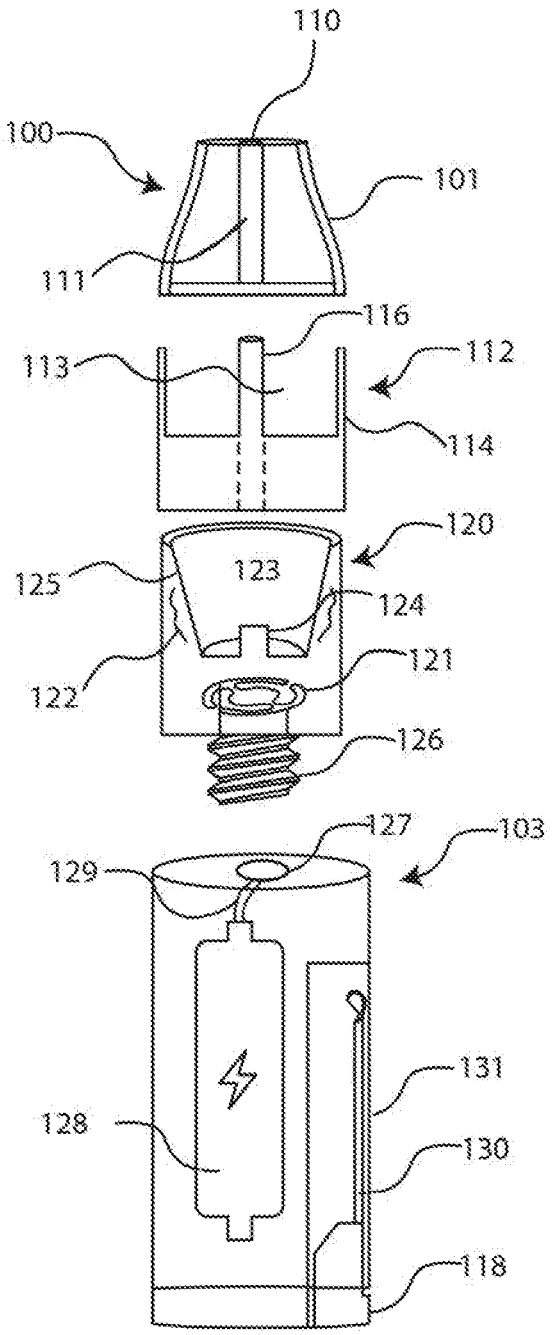
FIG. 7 shows a front view of an embodiment of the present invention.

As shown in FIG. 7, the DEN PEN embodiment of the present invention is shown as an inhaler 100. Mouthpiece 101 rests atop body 103 in direct communication with top storage 112. Mouthpiece 101 include aperture 110 to allow exiting vapor from inhaler 100. Aperture 110 forms the termination of tube 111. Tube 111 fits over airflow tube 116 which provides fluid communication to allow vapor to pass from heating chamber 120 through air flow tube 116 to aperture 110. Storage compartment 113 is surrounded by top storage wall 114 and forms a space around the air flow tube 116. Preferably, storage 113 is shaped as an annulus around the tube and circumscribed by wall 114. Heating chamber 120 is preferably a replaceable part that can be removed, replaced, or otherwise interchangeable to provide the appropriate heating depending on the form/type of substance being used. Heating chamber 120 includes cavity 123 for application, store, and heating of the material. Nub 124 may be included in the heating chamber to provide for a pace and shape for ease of deposition of substance, specifically, a sticky wax. Given the nature of wax, and other sticky/crumbly substances, the nub may be pointed, sharp, flat, or otherwise shaped to adapt to collect a deposit of material for heating. Bottom coil heater 121 may be included below the heating chamber, and walls may include embedded heating elements 122. Heating chamber 120 can be impermantently attached to body 103 via threads 126 which may mate with internal threads 127 of body 103. It is not necessary that the threads are arranged with male and female in like position as shown, but may be arranged or formed for any interlocking mechanism to impermantently attach heating chamber to body. Preferably, lower mating portion, such as receiving threads 127, include a contact 129 to provide for power source 128 to power coils in heating chamber. In one embodiment, as single contact suffices to connect all coils, as bottom heating coil 121 may be electronically coupled to wall heating coils 122.

Body 103 may also include additional storage for scoop tool 30, such as a spoon or other like device, in bottom chamber 131 accessed through bottom cap 118.

Figure 8:
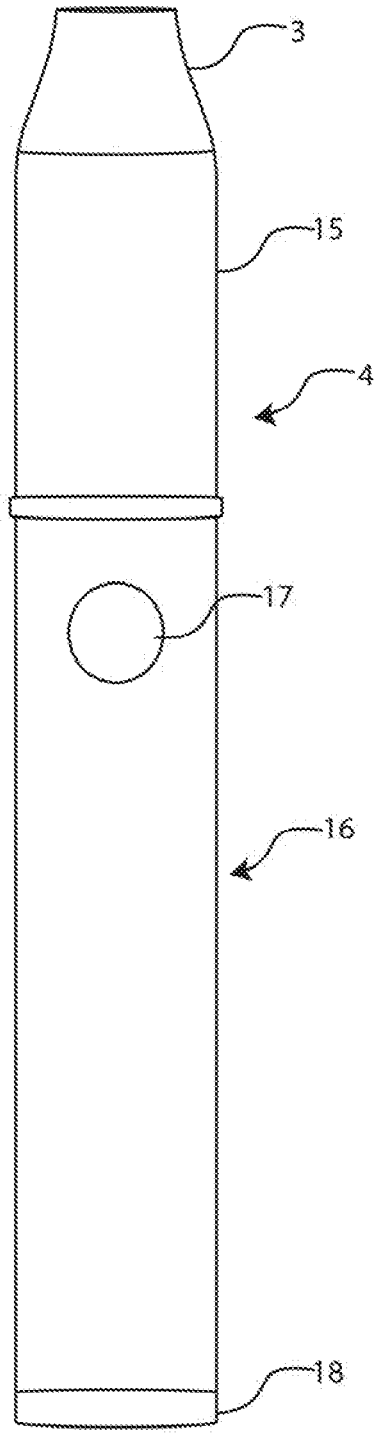
FIG. 8 shows a cross-sectional view of an embodiment of the present invention as shown in FIG. 7.

Top storage 112 is directly above power source and heater of main body. Battery may be housed in lower section 16. Power may be activated by switch 17 such as a button to power on the device for a limited time. Access to lower compartment 16 is provided via tool base 18 at bottom of lower compartment. As can be more fully shown in FIG. 8, mouthpiece 3 rests atop storage 15. Storage 15 includes a tubular connection such as tube 16 shown to provide for fluid communication between heatering chamber 10 and mouthpiece 3. In such a way, the heating chamber and the mouthpiece are separated to allow for some cooling of the air leaving the heating chamber. Storage space 18 within top storage 15 can be used to hold additional volatile compound or otherwise be used to provide a cooling mechanism while heated gases or vapors leave heating chamber 10 and pass through tube 16 towards mouthpiece 3. Bottom compartment 16 includes door 18 that can provide access to the power source and/or a storage area to house a tool 30.

Figure 9:
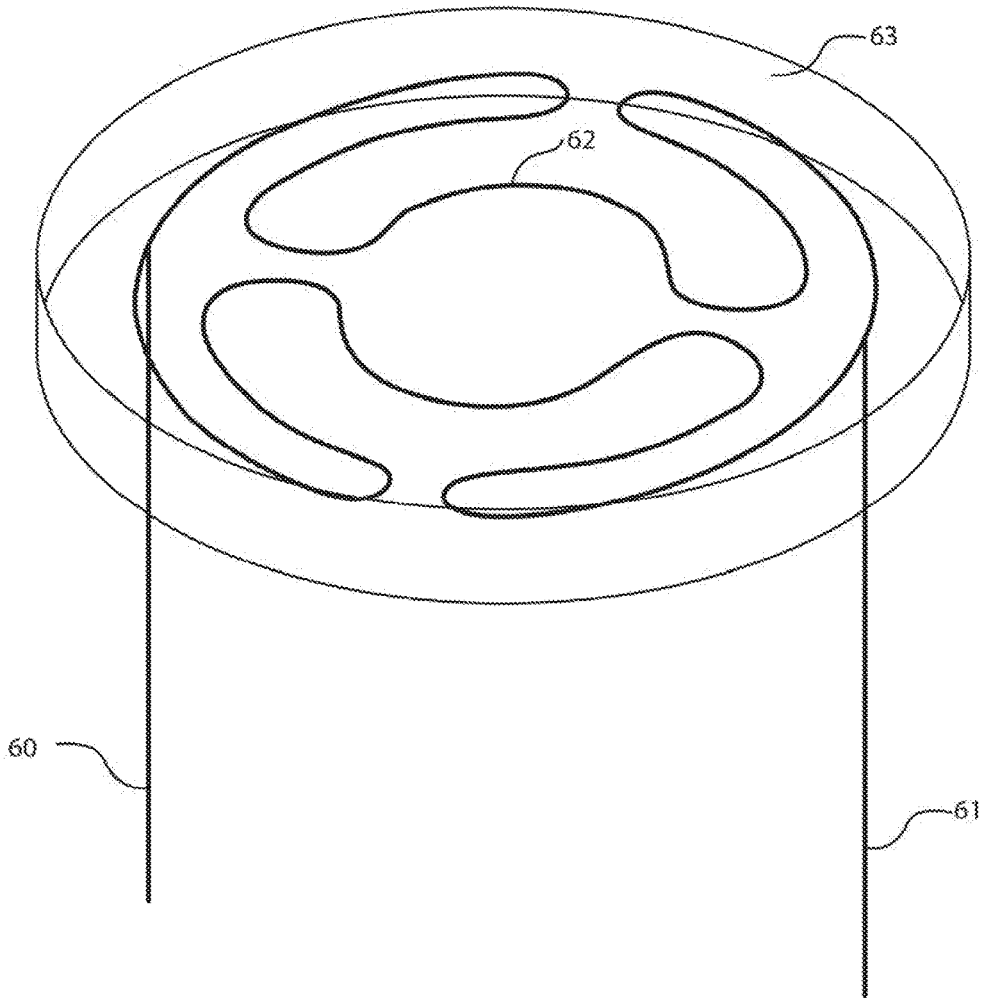
FIG. 9 shows a perspective view of a heating element of an embodiment of the present invention.
Figure 10:
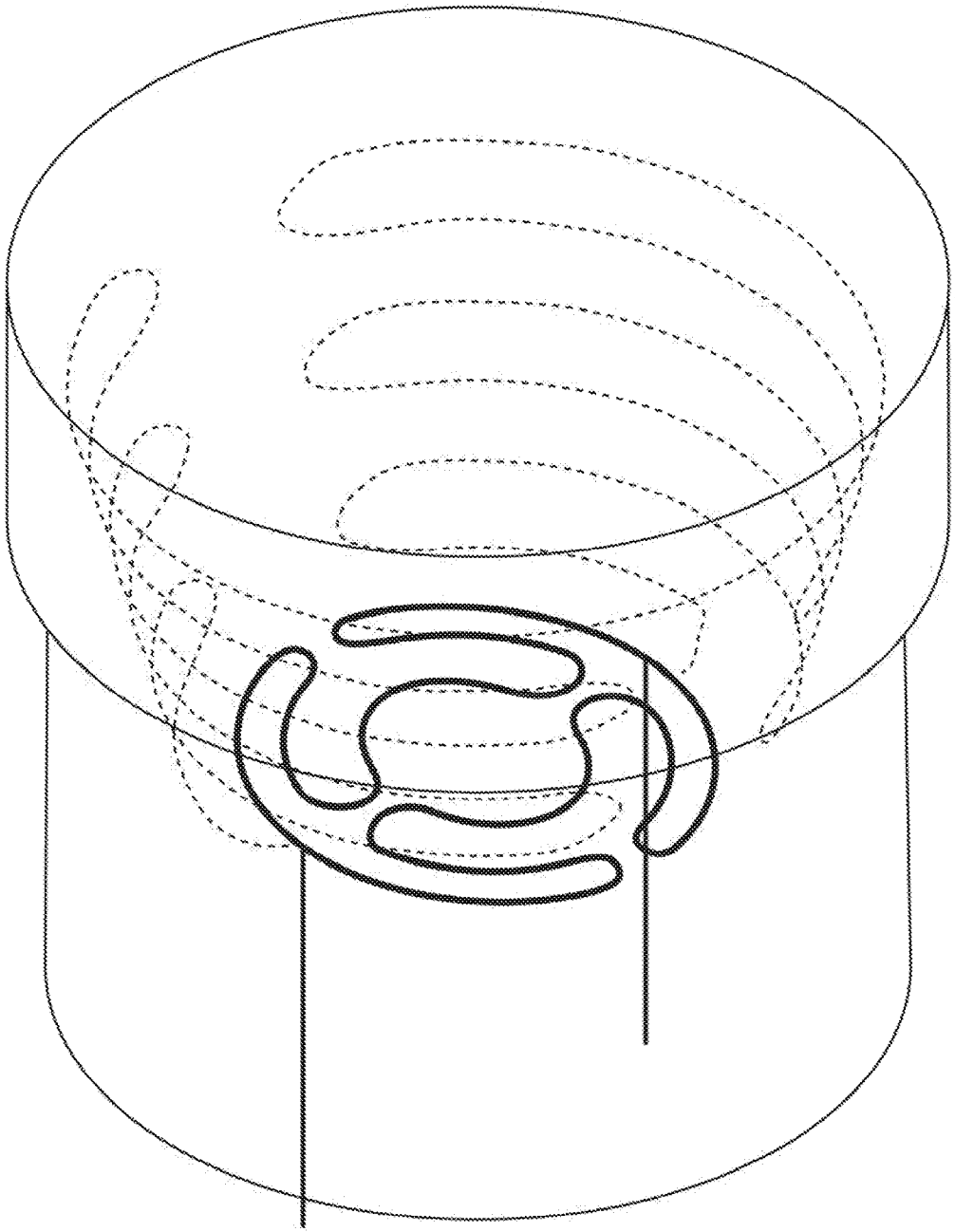
FIG. 10 demonstrates a heating chamber with embedded heating elements of an embodiment of the present invention.

As can be shown in FIG. 9, a heating element of the present invention is shown. Advances in technology of materials manufacturing and contacts allows now for embedded heaters in a material such as a glass, a ceramic, or a glass-ceramic as may be wanted or useful in the present invention. In this embodiment, lead lines 60 and 61 provide for an electrical path through heating wires 62 that are embedded into a disc 63 that serves as the floor for a heating chamber. As can be further illustrated in FIG. 10, heating wires may be embedded within the walls of the heating chamber.

Figure 11:
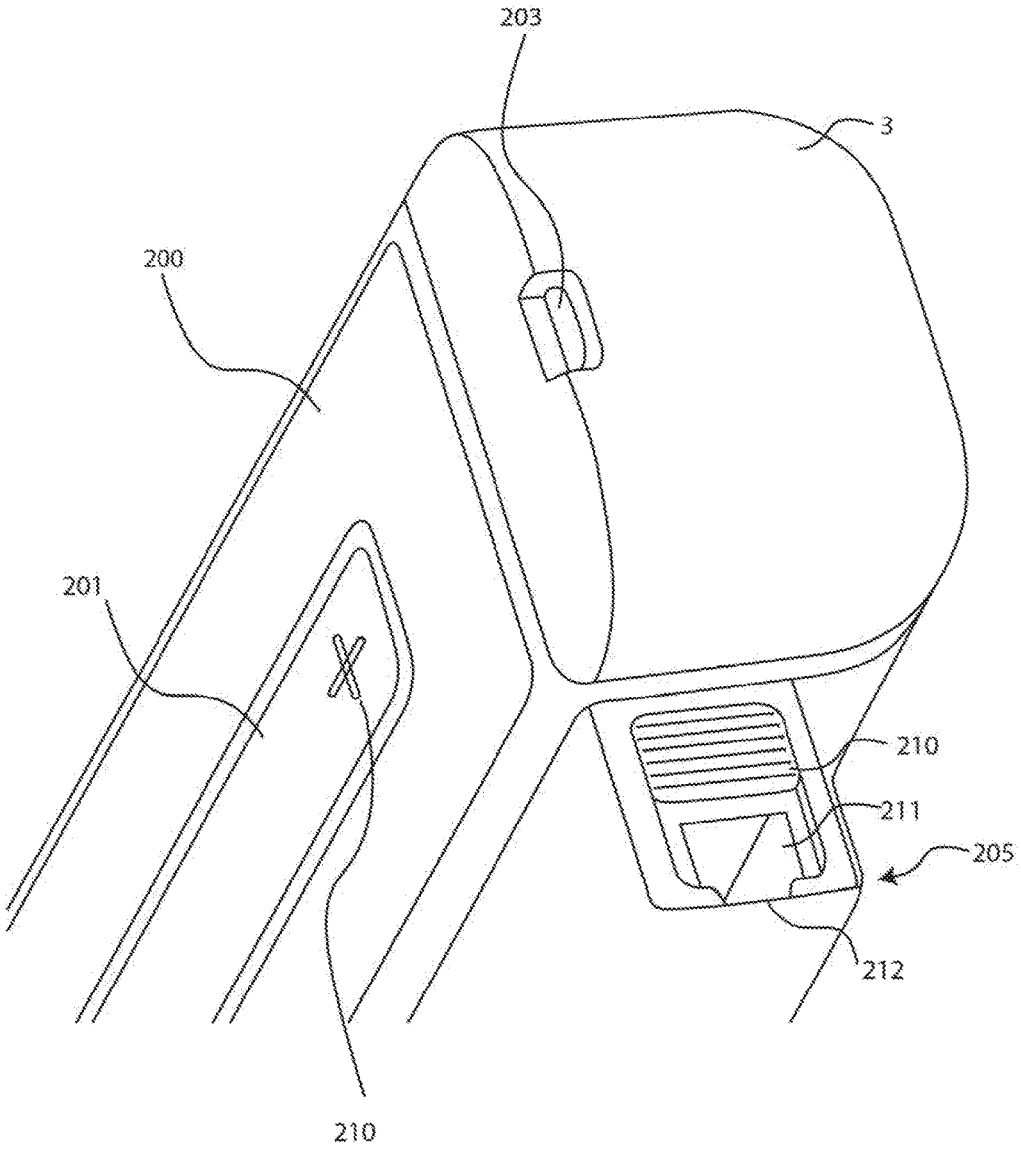
FIG. 11 demonstrates a perspective top view (partial) of an embodiment of the present invention.

FIG. 11 demonstrates a top perspective view of the top portion of the present invention. The mouthpiece 3 serves as the top for the device including a mouth hole 203. Device face 200 may include a display 201 that shows the status of the system, and/or the temperature of the heating chamber, and/or any sort of personalized message. Display may include a "+" and a "–", here + sign 210, to activate increasing the heating chamber preferred temperature. Storage compartment 205 is shown here with sliding door 210 210, which moves according to double arrow 230, providing access to storage cavity 211 via the top of the storage compartment. It is preferred that the storage compartment is detachable and provides for removal of the storage compartment to then pour through the lip 212 into heating chamber.

Figure 12:
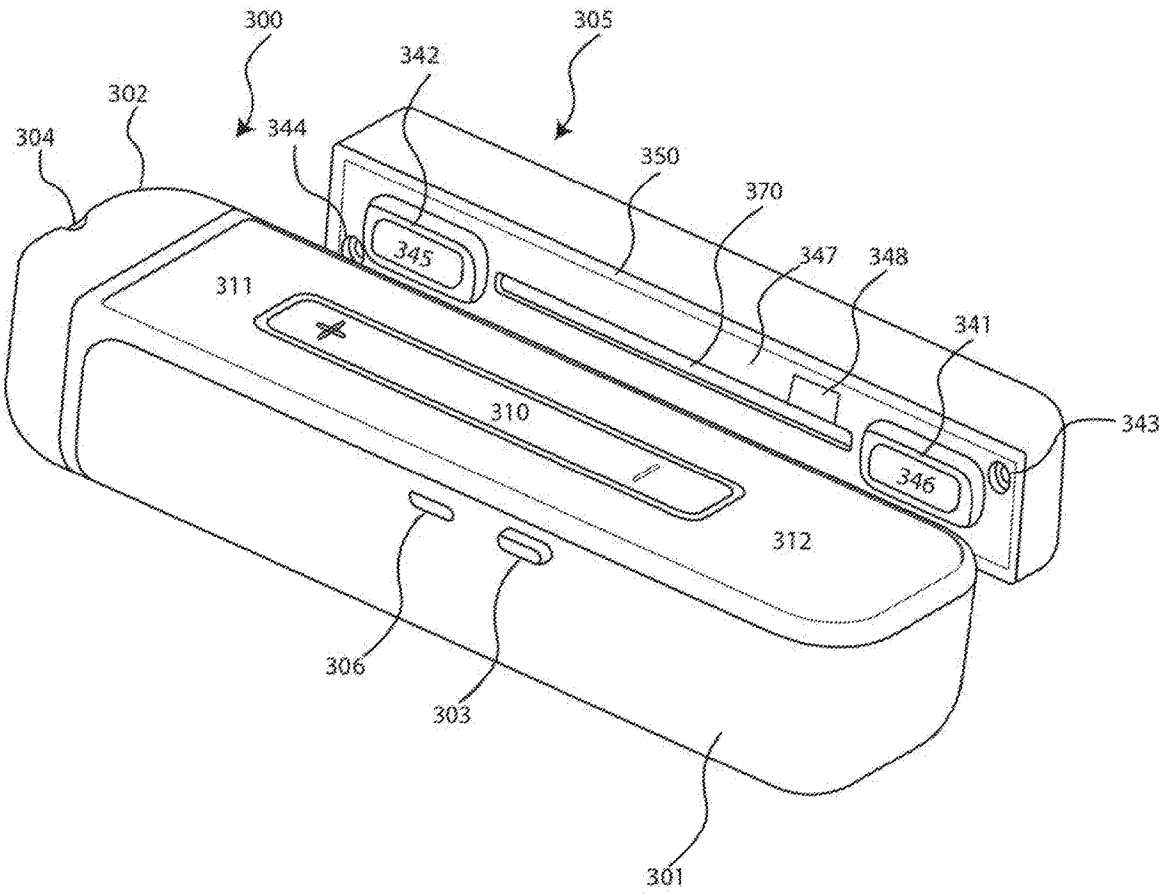
FIG. 12 demonstrates a partially exploded perspective side view of an embodiment of the present invention.

FIG. 12 demonstrates another alternative embodiment of the present invention. Portable vaporizer 300 includes main body 301 and detachable storage compartment 305. Main body 301 includes charging port 306 and power actuator switch 303. Screen 310 may be provided to show status, such as temperature or power mode, via LED screen, LCD screen or other display as is known in the art. An embedded light emitter 311 may be included on face 312, such as an LED light indicating bulb. Mouthpiece 302 may include access to opening 304 towards a mouth air flow tube that would otherwise be in fluid connection with a heater to allow vapor to exit portable vaporizer 300.

Detachable storage element 305 includes rim 350 structured to mate with complementary features on body 301 of portable vaporizer 300. Detachable storage 305 may also include extending bosses top boss 342 and bottom boss 341 that provide for further complementary mating side features of the portable vaporizer. Particularly, top boss 342 may include an embedded magnet 345 to mate with a magnet in portable vaporizer. In the same way, bottom magnet 346 may be embedded within, or otherwise exposed from, lower boss 341 to mate with a magnet and/or magnetizable material in portable vaporizer. Indentations 343 and 344 may be included to mate with bosses emanating from the side of portable vaporizer (not shown), or may otherwise be useful to provide access to screw mechanism to put detachable storage together. Furthermore, a tool 370, such as a rod or otherwise a scoop tool, may be employed and fitted on face within indentation 347. Indentation 347 may include a finger protrusion 348 at right angle from longitudinal length of indentation for tool.

Figure 13:
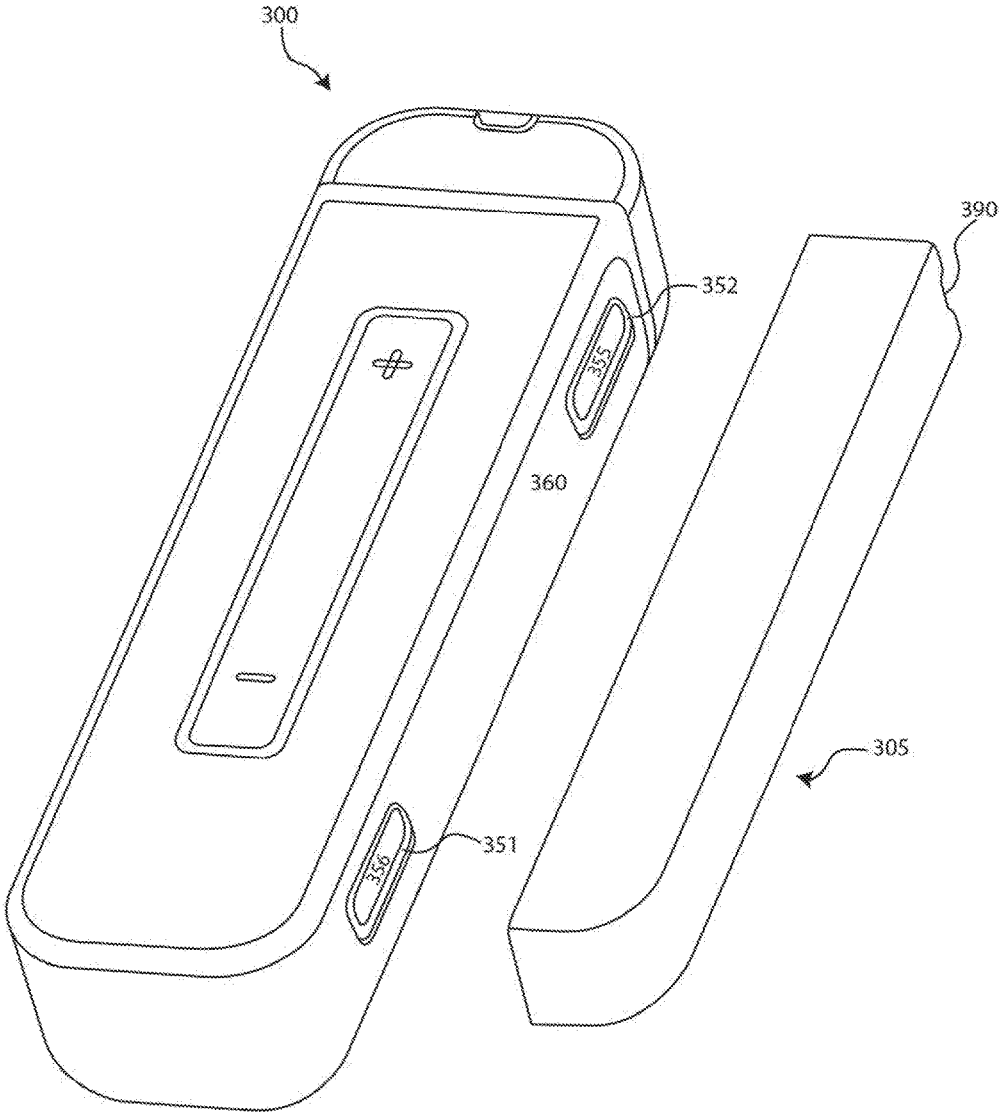
FIG. 13 demonstrates a partially exploded perspective view of an embodiment of the present invention.

As can be shown in FIG. 13, portable vaporizer 300 includes detachable storage 305. Side 360 includes features such as top indentation 352 and bottom indentation 351 to mate with complementary boss features within the detachable storage 305. Alternatively, portable vaporizer may include bosses to mate with indentations within the storage element. Storage access point 390 may be included to provide access to materials within storage.

Figure 14:
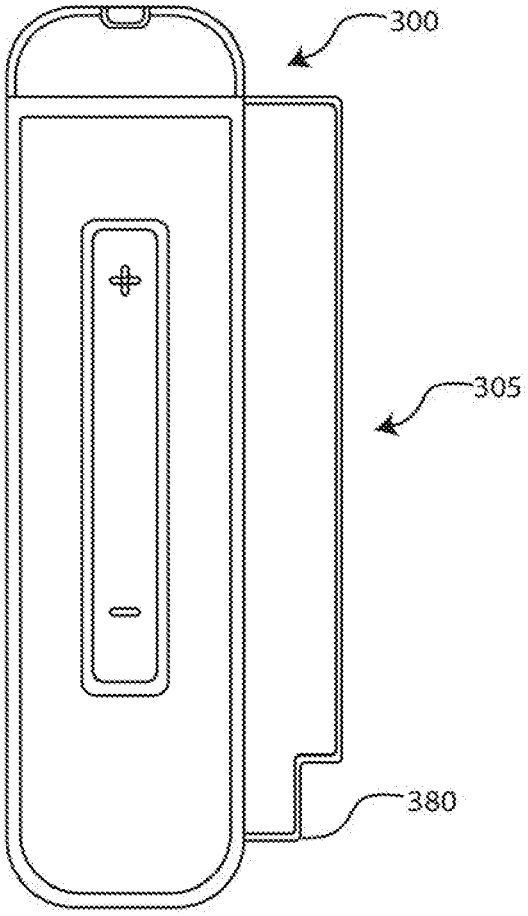
FIG. 14 shows a front view of an embodiment of the present invention.

FIG. 14 demonstrates a frontal view of another embodiment of the portable vaporizer 300. In this case, detachable storage 305 includes an external feature 380 to allow for packing of volatile material into the heating chamber. The shape of the external feature 380 should complement or otherwise fit well into the heating chamber. For instance, if the heating chamber has two parallel sidewalls, the external feature 380 may include a hard edge, perhaps at a 90 degree bend. Otherwise, external feature 380 may include a rounded edge, point, or otherwise be shaped to adapt to fit well to pack material, such as dry herb, wax, dehydrated herb, etc. into the heating chamber.

Figure 15:
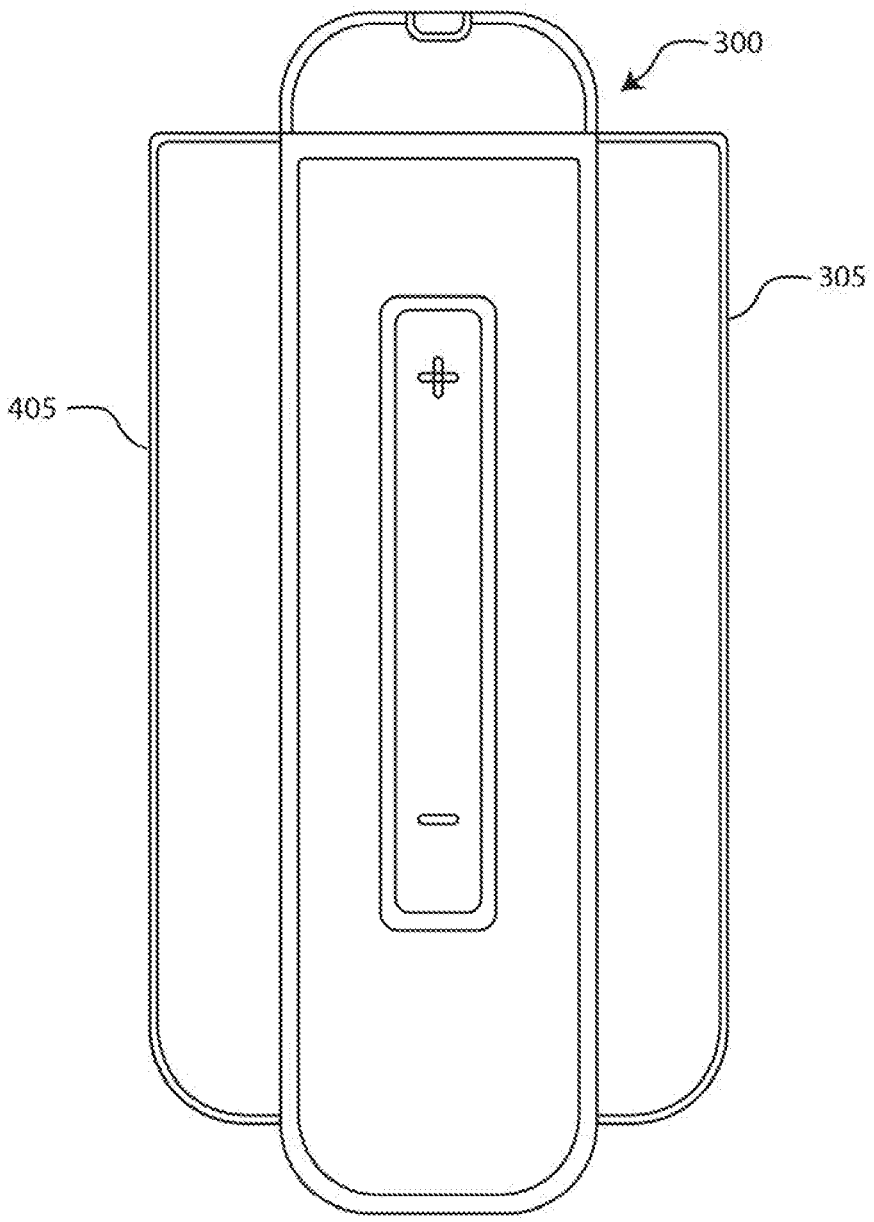
FIG. 15 shows another frontal view of another embodiment of the present invention.
Figure 16:
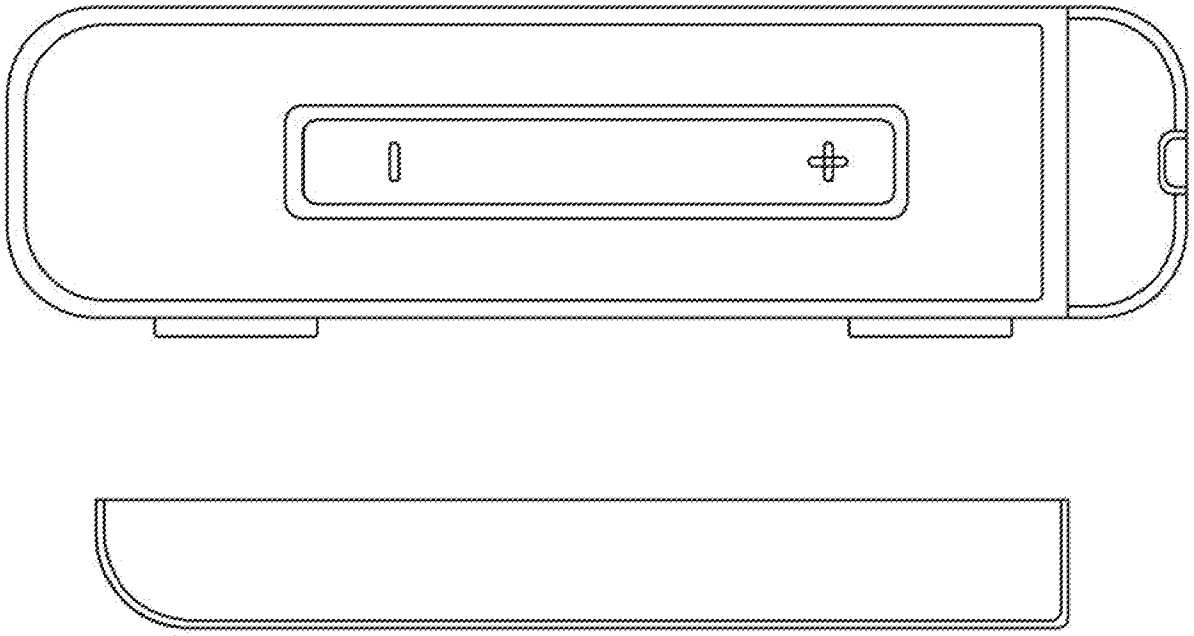
FIG. 16 shows a partially exploded frontal view of an embodiment of the present invention.

Another alternative embodiment is shown in FIGS. 15 and 16. For instance, FIG. 15 shows dual side detachable storage elements 305 and 405 off of portable vaporizer 300. In this example, storage compartment 405 may operate similarly to storage compartment 305, as discussed above.

Figure 18:
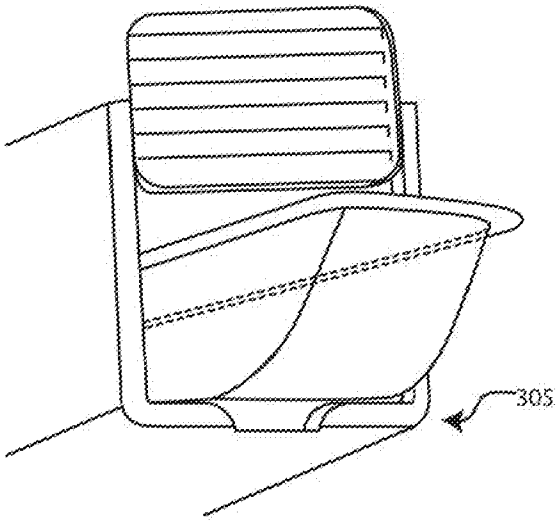
FIG. 18 demonstrates a top partial transparent perspective view (up close) of an opening end of a storage compartment of the present invention shown in FIG. 17.
Figure 17:
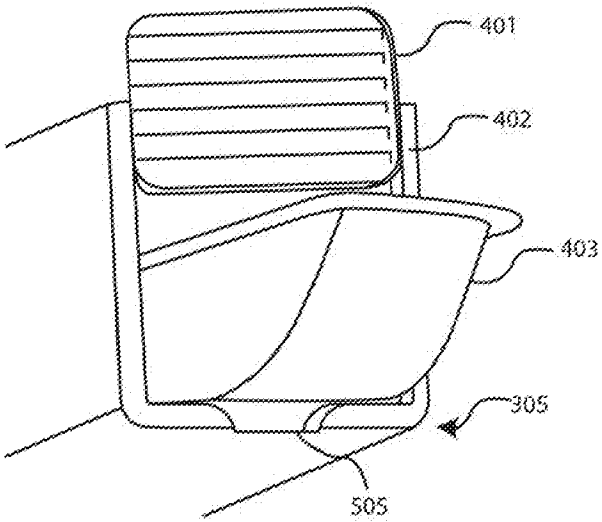
FIG. 17 demonstrates a top partial perspective view (up close) of an opening end of a storage compartment of the present invention.
Figure 20:
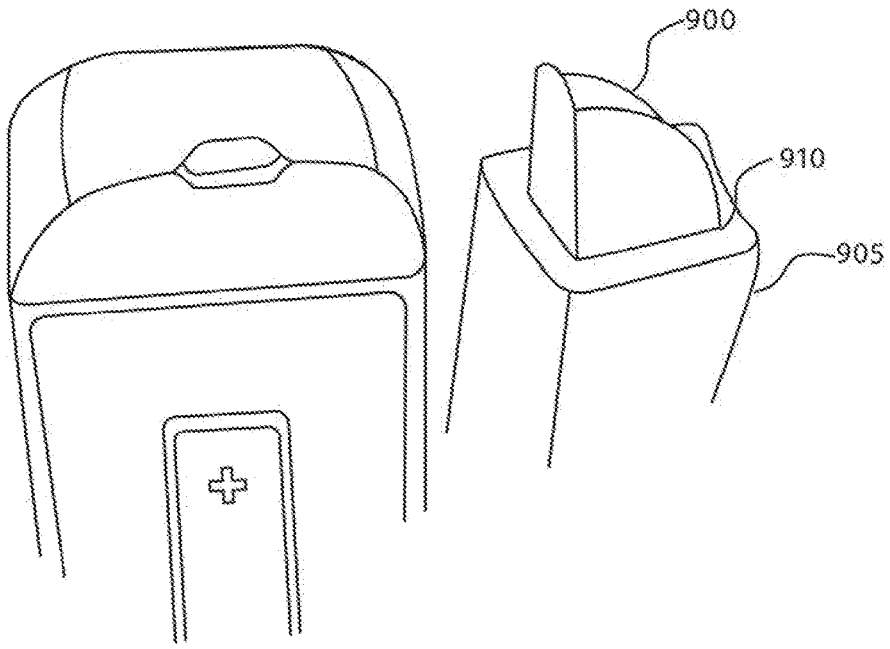
FIG. 20 shows a partial perspective top view of an alternative embodiment of the present invention.
Figure 22:
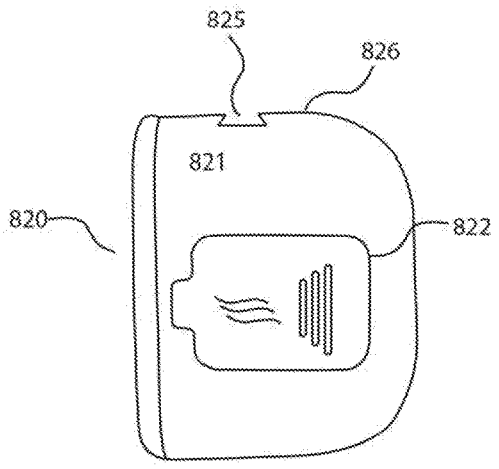
FIG. 22 shows a top side view of an embodiment of the present invention.
Figure 24:
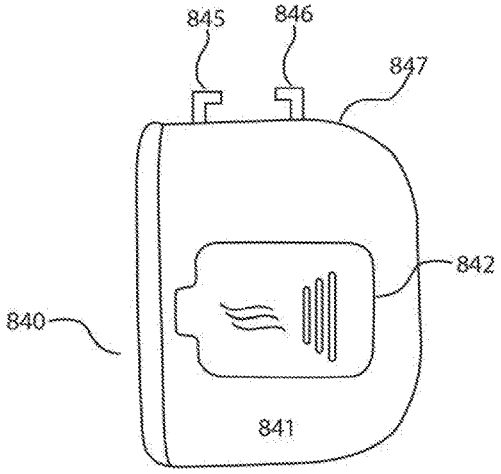
FIG. 24 shows a top side view of an embodiment of the present invention.
Figure 21:
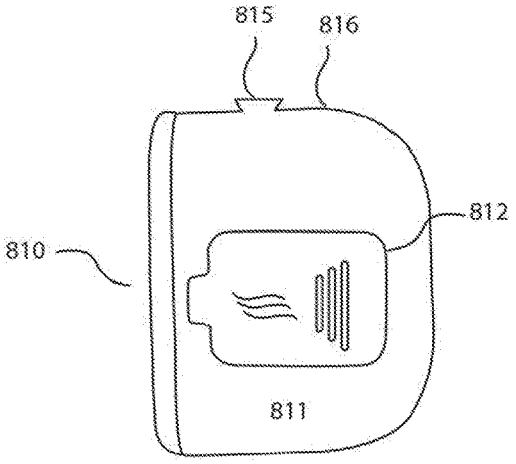
FIG. 21 shows a top side view of an embodiment of the present invention.
Figure 23:
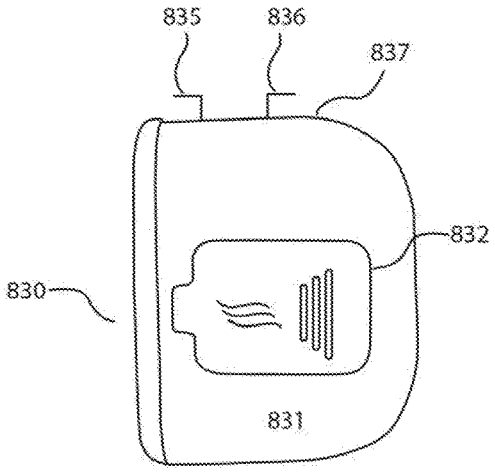
FIG. 23 shows a top side view of an embodiment of the present invention.

Many users will like to store more than one volatile substance type. There are many strains, consistencies, flavors, and potencies of these substances that a barrier in the storage compartment could help keep them separate from each other. In an alternate embodiment, the detachable storage 305 may include various features to provide for easier access, storage, and deployment of material therein. As shown in FIGS. 17 and 18, detachable storage may include a sliding door 401 that can move up and down along the top edge 402 of detachable storage 305 as a drawer. By moving door 401 up and thereby exposing the interior of detachable storage 305, one may access the material therein. Detachable storage 305 may include a sliding shelf 403 that acts as a tray that can otherwise provide for access to material in storage area via the top end 402, without having to access a longer or larger side of detachable storage. Furthermore, detachable storage may include a lip 505, such as an indented lip as shown, or an extending lip or funnel or other feature that provides for easier pouring from detachable storage 305 into a heating chamber. Sliding door 401 preferably opens towards the Lip may be shaped as a funnel, or integrated funnel, on the open end of the detachable storage. Funnel may be shaped similar to that of a retail residential salt canister as is known in the art, as depicted in FIG. 20. Funnel 900 attaches to detachable storage 905, along open end 910 for loading/unloading the storage attachment and loading the heating chamber. Funnel may also be considered and shaped as a spout as is known in the art for pouring. Pouring has proven to be a useful feature of the storage attachment. With a funnel, or spout, it may be easier and convenient to pour the material into the heater, which provides an improvement over using your fingers or pouring from an opening not really designed to pour various forms of substance.

Figure 19:
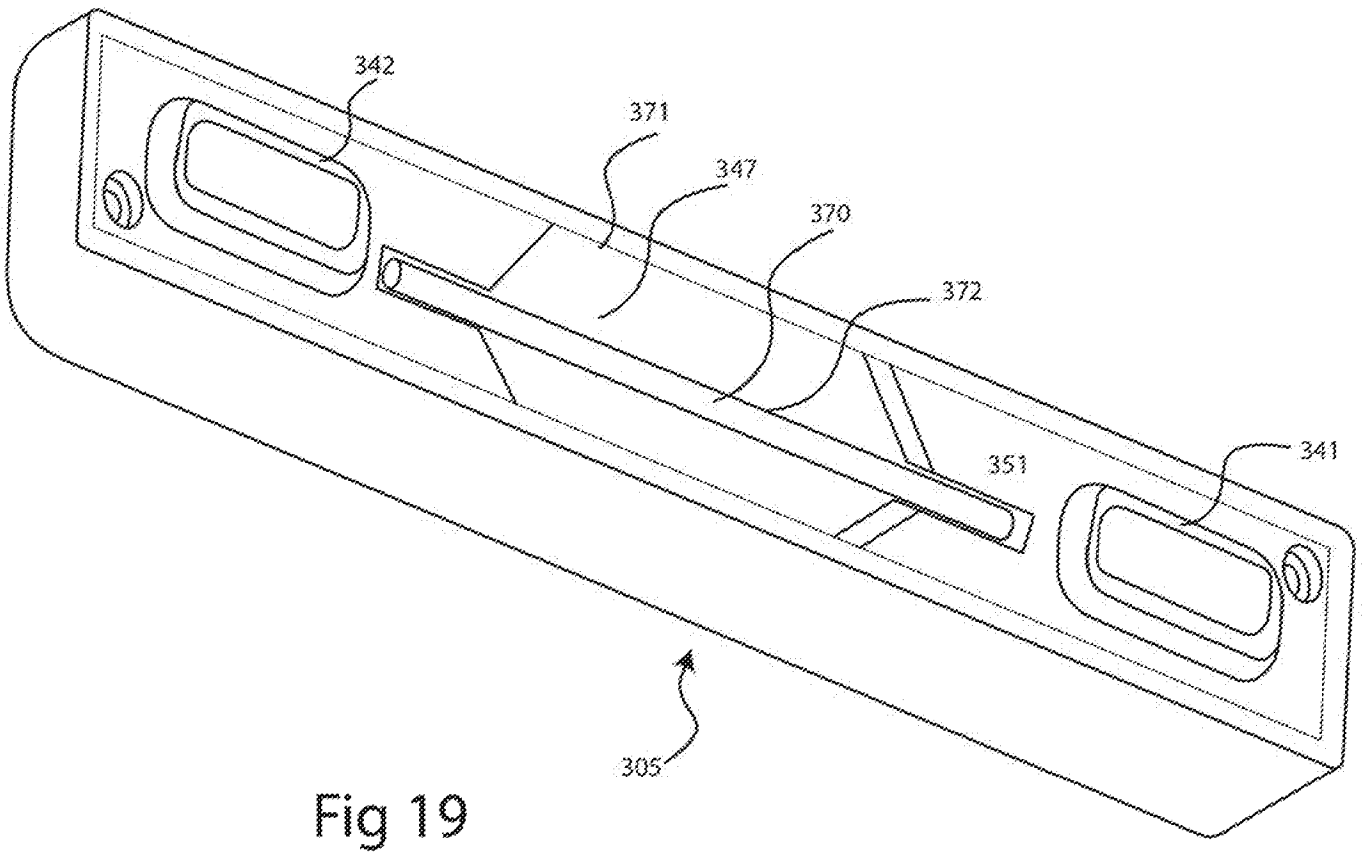
FIG. 19 shows a portion of a side perspective view of an embodiment of the present invention.

An alternative embodiment of the detachable storage 305 is shown in FIG. 19. Extending bosses 342 and 341 may be included. Furthermore, a tool 370, such as a rod or otherwise a scoop tool, may be employed and fitted on face within indentation 347. Tool may be magnetized itself or otherwise material subject to magnetization, such as a magnetically reacting metal. An embedded magnet 372 may reside at or below the surface of detachable storage face 351 to provide for locking and storing of tool 370 to face 351. Furthermore, an extending indentation 371 may be included to allow for access via finger to grip and pull tool 370 from detachable storage 305.

FIGS. 21 through 24 show alternative embodiments with various mating features to mate with complementary features on a detachable storage. This allows the detachable storage to slide along the side, as is known in the art to mate and attach. Vaporizer 810 includes top side 811 with access to heater through cap 812. Male dovetail tail 815 extends as a ridge along side 816 of vaporizer 810. This allows the detachable storage (not shown) with complimentary sockets to slide up onto vaporizer 810.

Vaporizer 820 includes top side 821 with access to heater through cap 822. Female dovetail socket 825 extends as a ridge along side 826 of vaporizer 820. This allows the detachable storage (not shown) with complimentary tail to slide up onto vaporizer 820.

Vaporizer 830 includes top side 831 with access to heater through cap 832. Outwardly extending arms 835 and 836 extend as a ridge or track along side 837 of vaporizer 830. This allows the detachable storage (not shown) with complimentary ridges to slide up onto vaporizer 830.

Vaporizer 840 includes top side 841 with access to heater through cap 842. Inwardly extending arms 845 and 846 extend as a ridge or track along side 847 of vaporizer 840. This allows the detachable storage (not shown) with complimentary ridges to slide up onto vaporizer 840.

Figure 25:
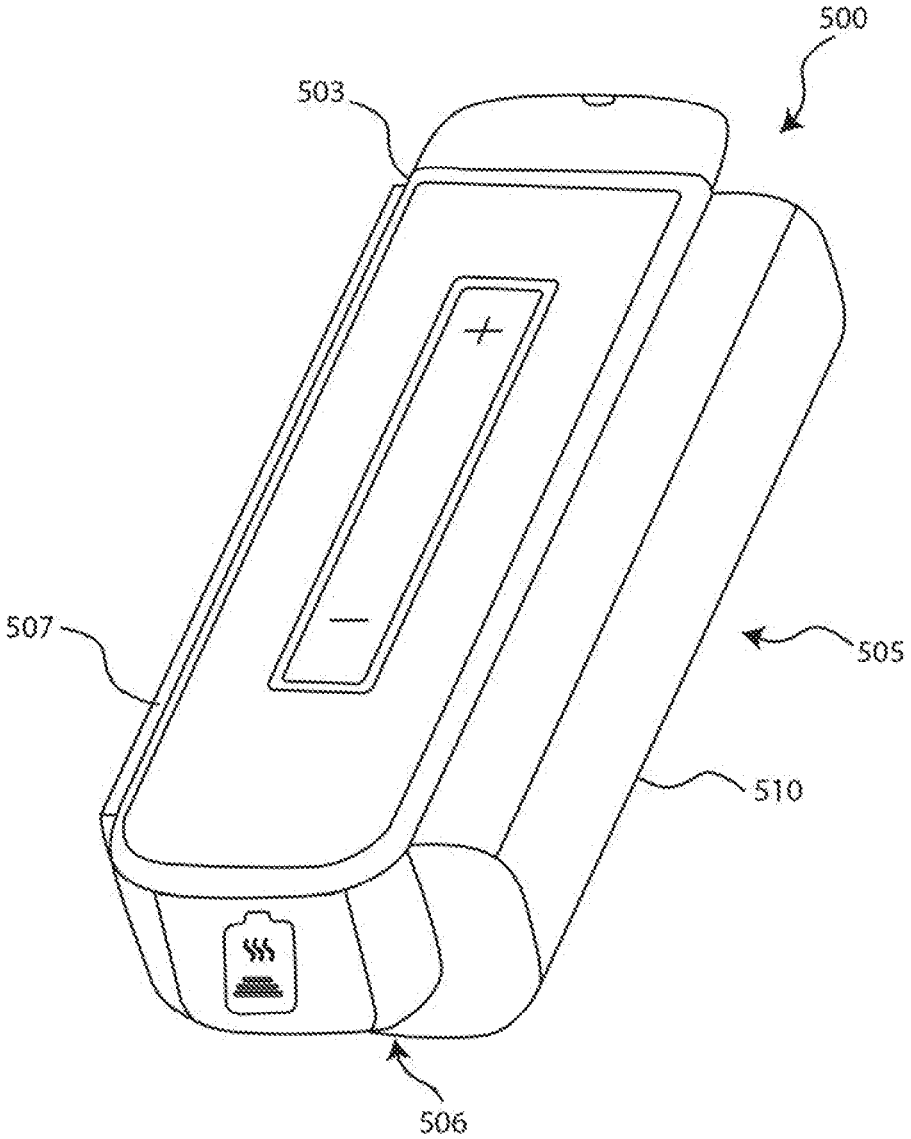
FIG. 25 shows a perspective view of an embodiment of the present invention.

FIG. 25 shows an alternative embodiment of inhaler 500 with sleeved detachable storage 505. Detachable storage compartment 505 included an extending back wall 506 to couple with the shape of the inhaler main body 503, and the back wall extends to a further r side wall clip 507 to attach to the inhaler main body. Storage is provided in detachable storage location 510. Ridges or other features (not shown) can be used to ensure that the detachable storage container does not slip.

Figure 26:
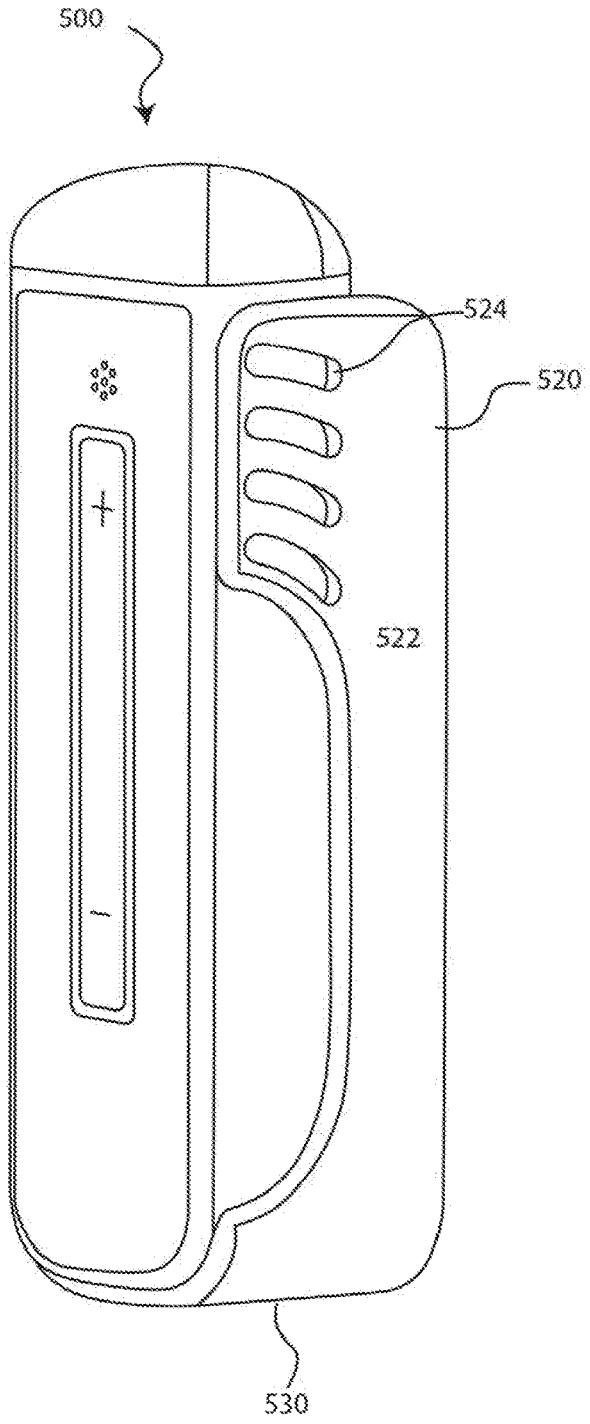
FIG. 26 shows a perspective view of an embodiment of the present invention.
Figure 27:
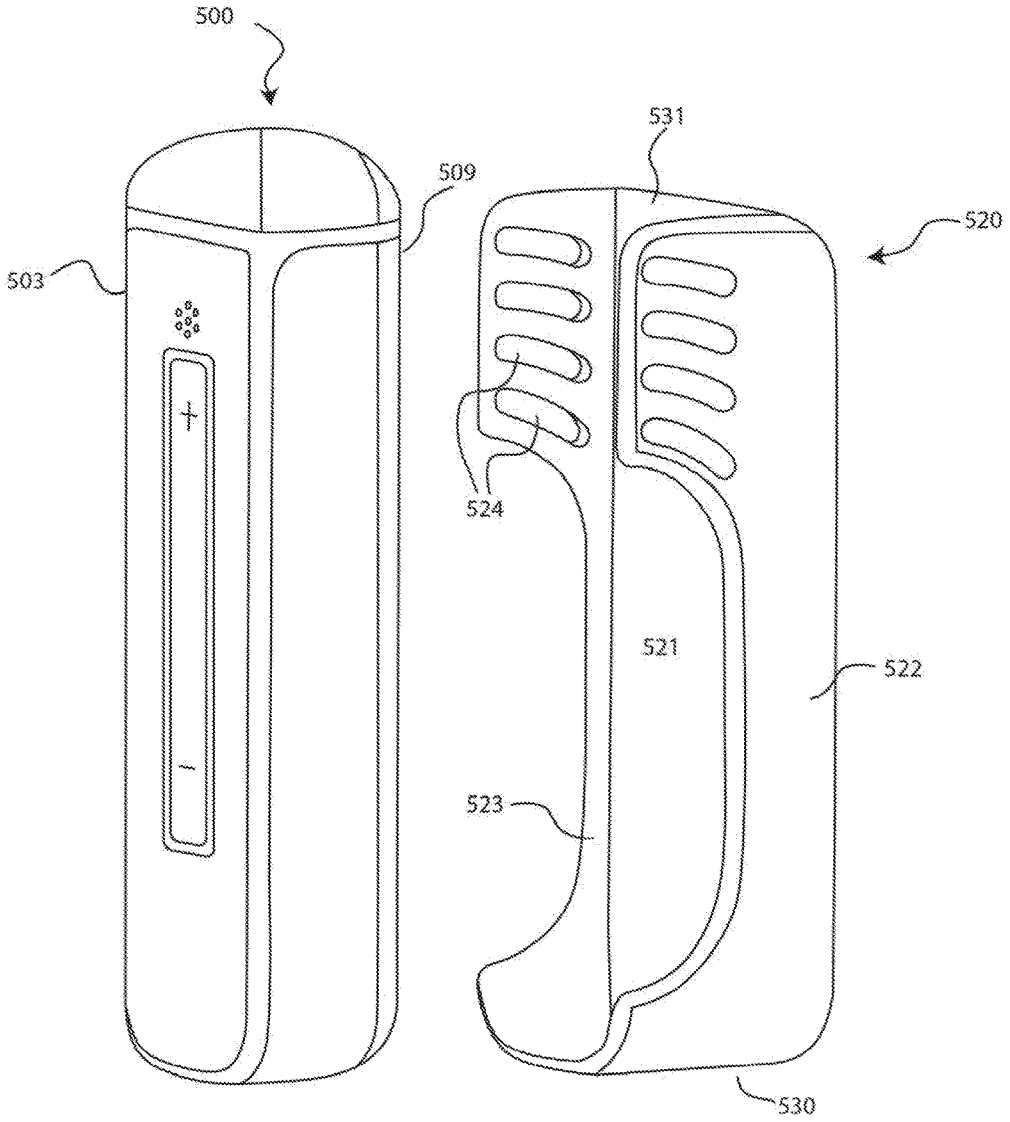
FIG. 27 shows a partially exploded perspective view of an embodiment of the present invention.

An alternative embodiment of the detachable storage is shown in FIGS. 26-27. Inhaler 500 includes main body 503. Detachable storage 520 includes back wall 521 to mate with main body back wall 509, while walls 522 and 523 grip, or otherwise form around the further structural elements of main body 503. Detachable storage 520 may include closed bottom 530 and open top 531 to allow for the detachable storage 520 to slide into place around inhaler main body 503. Back wall 521 and bottom 530 may be fitted with magnets to allow the detachable storage 520 to mate with complimentary features on main body 503. Optional slats 524, grips, or other ergonomic feature may be provided to allow ease of sliding the detachable store onto and off of main body.

Figure 29:
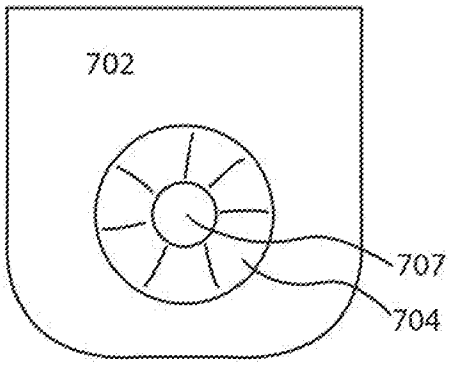
FIG. 29 shows a top view of the embodiment shown in FIG. 28.
Figure 28:
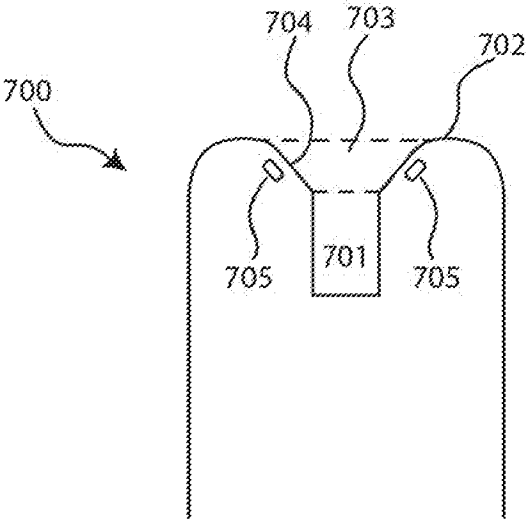
FIG. 28 shows a cross-sectional side view of an embodiment of the present invention.

As shown in FIGS. 28 and 29, the heating chamber 701 may be fitted on an edge, such as top edge 702 of inhaler 700. Above heating chamber 701 may be angled sloping walls 704 that forma sort of funnel to provide for ease of filling heating chamber with a volatile substance for use. Substance can be pored over the top end 702 and into heating chamber 701, while material that slightly misses the heating chamber, can thereby be directed by sloping walls 704 in to heating chamber 701, to rest at heating chamber floor 707. Cap 703 may be used to seal heating chamber, preferably shaped as a partial cone. Magnets 705 may be embedded behind walls 704 to provide for a snap-on cap function.

I claim:

1. A vaporizer for the heat combustion of volatile material to provide a vapor for inhalation by a user, said vaporizer comprising:

a) a body comprising an exterior surface, said exterior surface comprising a bottom, and at least one side;

b) a heating chamber coupled to a heating element;

c) a channel in fluid communication with said heating chamber and a mouthpiece, said mouthpiece along said exterior surface of said vaporizer and adapted to allow the user to draw vapor from said heating chamber through said channel and out of said vaporizer;

d) a detachable storage compartment coupled with said exterior surface at least one side;

e) a tool disposed between said exterior surface and said detachable storage compartment;

wherein said detachable storage compartment comprises a fastening mechanism for detachably mating said detachable storage compartment with said at least one side.

2. The vaporizer of claim 1 wherein said detachable storage compartment comprises a first side adapted to mate with the at least one side of said body; wherein at least one of said top and bottom comprises a first resealable closure means for accessing a storage area within said detachable storage compartment.

3. The vaporizer of claim 2 further comprising a second resealable closure means on the other of said at least one of said top and bottom.

4. The vaporizer of claim 2 further comprising a lip spout along an edge of said resealable closure means.

5. The vaporizer of claim 2 wherein said at least one side comprises an extending rim, and said first side comprising a recessing rim to provide for complimentary mating of said body with said detachable storage compartment.

6. The vaporizer of claim 1 wherein said detachable storage compartment comprises a first side adapted to complimentarily mate with the at least one side of said body, said first side comprising said fastening mechanism, said first fastening mechanism comprising at least a top magnet, a bottom magnet and a center magnet; wherein each of said top, bottom, and center magnets permanently coupled to said detachable storage compartment along said first side.

7. The vaporizer of claim 6 wherein said detachable storage compartment first side comprises a top indentation aligned with said top magnet, and a bottom indentation aligned with said bottom magnet.

8. The vaporizer of claim 7 wherein said first side comprising a tool holder indentation between said top indentation and said bottom indentation.

9. The vaporizer of claim 8 wherein said tool holder indentation includes a magnetic mating element to attract and hold a metallic tool.

10. The vaporizer of claim 7 wherein said tool holder indentation comprises a longitudinally extending indentation along a first axis and further comprising a finger indentation arranged at a right angle offset said first axis.

11. The vaporizer of claim 1 wherein said heating chamber comprises a chamber shape;

wherein said detachable storage compartment comprises a first side adapted to complimentarily mate with the at least one side of said body;

wherein said detachable storage compartment further comprises a surface shape reflection of said chamber shape and adapted to complimentarily mate with said chamber shape.

12. The vaporizer of claim 2 wherein said first resealable closure means comprises a sliding door.

13. The vaporizer of claim 12 wherein said sliding door is coupled to said storage compartment and adapted to slide open in the direction of the first side of the storage compartment.

14. The vaporizer of claim 2 wherein said sliding door is biased closed against the at least one side of said body when said storage compartment is attached to said body.

15. A vaporizer for the heat combustion of volatile material to provide a vapor for inhalation by a user, said vaporizer comprising:

f) a body comprising an exterior surface, said exterior surface comprising at least one side;

g) a heating chamber coupled to a heating element within said body;

h) a channel in fluid communication with said heating chamber and a mouthpiece;

i) a detachable storage compartment coupled with said exterior surface said at least one side;

wherein said detachable storage compartment comprises a magnetic fastening mechanism for detachably mating said detachable storage compartment with said at least one side.

16. The vaporizer of claim 15 wherein said detachable storage compartment comprises a first side adapted to mate with the at least one side of said body; and further comprising a first sliding door.

17. The vaporizer of claim 16 wherein said first sliding door is adapted to bias closed when said detachable storage compartment is mounted upon said at least one side.

18. The vaporizer of claim 15 further comprising a tool mounted on said storage compartment first side, wherein said detachable storage and said body enclose said tool when said detachable storage is mounted on said body.

19. The vaporizer of claim 15 further comprising a sliding shelf within said detachable storage compartment.

20. A vaporizer for the heat combustion of volatile material to provide a vapor for inhalation by a user, said vaporizer comprising:

a) a body comprising an exterior surface, said exterior surface comprising a bottom, and at least one side;

b) a heating chamber coupled to a heating element;

c) a channel in fluid communication with said heating chamber and a mouthpiece, said mouthpiece along said exterior surface of said vaporizer and adapted to allow the user to draw vapor from said heating chamber through said channel and out of said vaporizer;

d) a detachable storage compartment coupled with said exterior surface at least one side;

wherein said detachable storage compartment comprises a first side adapted to mate with the at least one side of said body; a side opposite said first side; and a top and bottom disposed between said first side and said side opposite;

wherein at least one of said top and bottom comprises a first resealable closure means for accessing a storage area within said detachable storage compartment;

wherein said detachable storage compartment comprises a fastening mechanism for detachably mating said detachable storage compartment with said at least one side; and e) a lip spout along an edge of said resealable closure means.

* * * * *